US006842989B1

(12) United States Patent
Wuthrich

(10) Patent No.: US 6,842,989 B1
(45) **Date of Patent: *Jan. 18, 2005**

(54) BOW SIGHT ADJUSTMENT MECHANISM

(76) Inventor: Jeffrey J. Wuthrich, 25460 200th St., Bloomfield, IA (US) 52537

( * ) Notice: Subject to any disclaimer, the term of this patent is extended or adjusted under 35 U.S.C. 154(b) by 0 days.

This patent is subject to a terminal disclaimer.

(21) Appl. No.: 10/657,911

(22) Filed: Sep. 9, 2003

Related U.S. Application Data

(63) Continuation of application No. 10/210,135, filed on Aug. 1, 2002, now Pat. No. 6,688,008.

(51) Int. Cl.[7] ..... F41G 1/467
(52) U.S. Cl. ..... 33/265; 124/87
(58) Field of Search ..... 33/265; 124/87

(56) References Cited

U.S. PATENT DOCUMENTS

| | | | | |
|---|---|---|---|---|
| 3,579,839 A | 5/1971 | Kowalski | 33/265 |
| 4,457,076 A | 7/1984 | Heck | 33/265 |
| 4,543,728 A | 10/1985 | Kowalski | 33/265 |
| 5,228,204 A | 7/1993 | Khoshnood | 124/87 |
| 5,384,966 A | 1/1995 | Gibbs | 33/265 |
| 5,507,272 A | 4/1996 | Scantlen | 124/87 |
| RE36,266 E | 8/1999 | Gibbs | 33/265 |
| 5,941,226 A | 8/1999 | Marietta | 124/87 |
| 6,401,347 B1 | 6/2002 | Slates | 33/265 |
| 6,564,462 B1 | 5/2003 | Henry | 33/265 |
| 6,688,008 B1 * | 2/2004 | Wuthrich | 33/265 |

* cited by examiner

*Primary Examiner*—G. Bradley Bennett
(74) *Attorney, Agent, or Firm*—McKee,Voorhees & Sease, P.L.C.

(57) ABSTRACT

An improved bow sight adjustment mechanism for use with an archery bow is provided. The bow sight adjustment mechanism includes the provision of a dowel pin or similar article disposed between a slide lock and a slide stop to maintain a spaced apart relationship. The dowel pin also extends through the slide with a flexible bushing disposed between the dowel pin and the slide to minimize inadvertent movement of the bow sight adjustment mechanism which could effect the position of the bow sight.

20 Claims, 4 Drawing Sheets

BOW SIGHT ADJUSTMENT MECHANISM

This application is a Continuation of application Ser. No. 10/210,135 filed Aug. 1, 2002 now U.S. Pat. No. 6,688,008.

BACKGROUND OF THE INVENTION

1. Field of the Invention

The present invention relates to archery accessories. More particularly, though not exclusively, the present invention relates to an adjustable bow sight mechanism for use with a bow for shooting arrows.

2. Problems in the Art

Bow hunting has gained popularity in recent years. Today, several states sponsor bow hunting seasons for animals such as deer, elk, moose and bear.

Archery competitions are also becoming more popular. Archers are judged based upon the accuracy and precision of their shots.

Good archery skills are important to both bow hunters and competitive archers. The ability to consistently strike an intended target with an arrow is essential.

For hundreds of years archers shot arrows without any particular sighting mechanism. Rather the archer would learn by repetition and feel where to position his bow and arrow in order to hit his or her intended target or prey. This is often referred to as "instinctive shooting."

As an alternative to instinctive shooting, many archers today use some type of sighting mechanism. A typical bow sight usually includes a plurality of sighting pins that are used for alignment purposes. The sighting pins can be adjusted both horizontally and vertically. More than one pin is normally used in order for the archer to sight on targets at different distances. For example, the archer may set one pin for a 15 yard shot and another pin for a 25 yard shot. Varying the height of the pins will account for the projectile motion of the arrow, thus allowing the archer to improve his or her accuracy from various distances.

Although bow sights have helped archers and bow hunters improve the accuracy and precision with which they shoot, such sights still suffer from various deficiencies. Most significantly, the pins are difficult and cumbersome to adjust. Often times the sights require the use of Allen wrenches or other tools that are not easy to use in the field and require a great finger dexterity to use. Still further, adjusting the individual pins in this manner can often result in over-adjustment, as fine adjustments in the location of the pins are difficult to achieve.

Not surprisingly, others have sought to improve upon bow sights and mechanisms for adjusting the same. For example, U.S. Pat. Nos. 3,579,839 and 4,457,076 generally disclose the use of screw devices or thumb screws that are rotated to adjust a sighting pin in either the horizontal or vertical direction. A plunger or spring-loaded ball is disposed in a surface adjacent the head of the screw such that it projects into a detent on the screw. It is intended that use of such detent mechanisms would avoid the necessity of a separate locking mechanism on the device. Such adjustment devices also suffer from various problems. For instance, there is too much "play" or "give" in the adjustment mechanism such that it overshadows any adjustments to the pins that are made by rotating the thumb screws. A separate locking mechanism is therefore still required to eliminate this inadvertent movement of the bow sight adjustment mechanism.

Accordingly, a primary objective of the present invention is the provision of a bow sight adjustment mechanism that can be used without tools and the like and that does not require a separate locking mechanism.

A still further feature of the present invention is the provision a bow sight adjustment mechanism that eliminates inadvertent movement of the bow sight without the need for a separate locking mechanism.

Another objective of the present invention is the provision of a bow sight adjustment mechanism that is economical to manufacture and durable in use.

These and other features become apparent from the following description of the invention.

SUMMARY OF THE INVENTION

The present invention relates to an improved bow sight adjustment mechanism having a slide lock, a slide stop and a slide mounted between the slide stop and the slide lock on an elongated screw device. The improvement includes the addition of one or more dowel pins or similar rigid member extending between the slide lock and the slide stop. The slide, which moves about the length of the thumb screw in response to a rotation of the screw, also includes an aperture that allows the dowel pin to pass through the slide with a flexible bushing positioned between the dowel pin and the slide. The flexible bushing, preferably made of nylon, effectively absorbs any looseness or "slop" between the dowel pin and the slide, thereby minimizing inadvertent movement of the adjustment mechanism.

The present invention also includes a new method for sighting a bow having a sighting element with a plurality of pins. The method generally includes providing a bow, providing an adjustable bow, sight mechanism as described previously, attaching the bow sight adjustment mechanism to a bow, adjusting the plurality of pins individually to achieve a desired spacing of shots for different distances, and then adjusting the sighting element by rotating the screw devices that cause adjustment in the horizontal and vertical directions. Those skilled in the art will appreciate that once the archer determines the appropriate spacing for the pins for various distance intervals, the adjustment mechanism can be used to fine tune or more precisely adjust all of the pins at the same time. Of course, the bow sight adjustment mechanism also avoids the use of Allen wrenches and similar tools, as well as the need for a separate locking mechanism on the device.

BRIEF DESCRIPTION OF THE DRAWINGS

The present invention is illustrated by way of example and not limitation in the figures of the accompanying drawings in which.

DETAILED DESCRIPTION OF THE INVENTION

The present invention will be described as it applies to its preferred embodiment. It is not intended that the present invention be limited to the described embodiment. It is intended that the present invention cover all modifications and alternatives which may be included within the spirit and scope of the invention.

Figure 1:
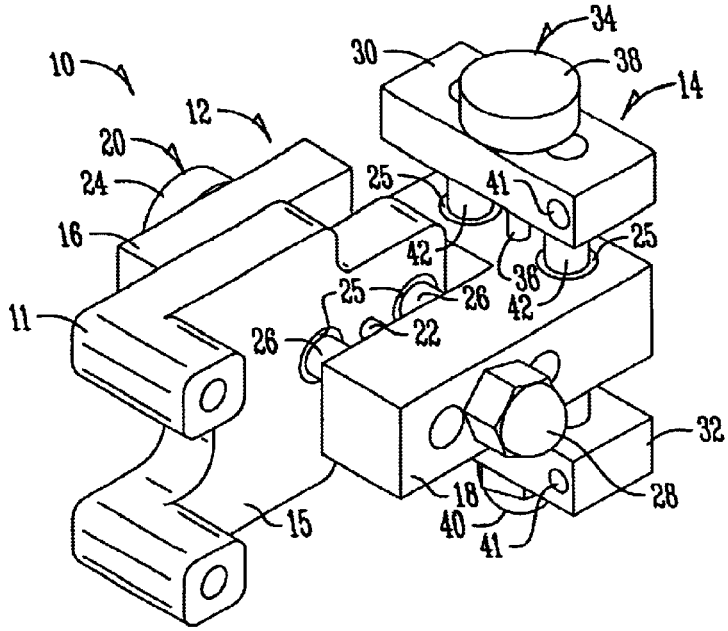
FIG. 1 is a perspective view of a preferred embodiment of a bow sight adjustment mechanism of the present invention.

Referring now to the drawings, a preferred embodiment of the bow sight adjustment mechanism 10 is show in FIG. 1. The bow sight adjustment mechanism 10 generally includes a sight mount 11, horizontal adjustment mechanism 12 and vertical adjustment mechanism 14.

The horizontal adjustment mechanism 12 includes a portion of the sight mount 11 (also referred to as a slide) that is disposed between a slide lock 16 and a portion of a L-shaped member 18 (also referred to as a slide stop). The slide lock 16 and slide stop 18 are held in a spaced-apart relationship by two dowel pins 26 that are pressed into the slide lock 16 and slide stop 18 about their opposite ends. As will be explained further, the dowel pins 26 provide stability in addition to maintaining the slide lock 16 and slide stop 18 in a spaced-apart relationship. A thumb screw 20 having an elongated shaft 22 and a bead 24 runs through the slide lock 16, the sight mount 11, and the slide stop 18. The shaft 22 of the thumb screw 20 is held at its terminal end by a hexnut 28. Rotating the head 24 of the thumb screw 20 causes the slide portion 15 of the sight mount to move along the longitudinal axis of the screw 22 and dowel pins 26. Note that flexible bushings 25 are disposed between the dowel pins 26 and the slide portion 15 of the sight mount 11. The purpose of the flexible bushings 25 is to allow the slide portion 15 to easily move along the longitudinal axis of the dowel pins 26 while filling in any gaps that may exist therebetween, which can result in inadvertent movement or "play" in the adjustment mechanism. The flexible bushings are key to the present invention, as they help ensure that the bow sight adjustment mechanism 10 does not have significant internal movement.

The vertical adjustment mechanism 14 similarly includes a slide lock 30, a slide stop 32, and a portion of the L-shaped member 18 that acts as a slide. The vertical adjustment mechanism includes dowel pins 42 that extend between the slide lock 30 and the slide mount 32. The vertical adjustment mechanism 14 also includes a thumb screw 34 with an elongated shaft 36 and a head 38 as previously described. The terminal end of the elongated screw 36 is again held in place by means of a hexnut 40. Flexible bushings 25 are also disposed between the L-shaped member 18 (or slide for purposes of the vertical adjustment mechanism 14) and the dowel pins 42. The slide lock 30 and slide stop 32 also include apertures 41 for mounting a sighting element which generally includes a plurality of pins (not shown).

It should be understood that the present invention is not limited to the use of dowel pins, but can include other rigid spacing elements.

It can be appreciated that the L-shaped member 18 acts as a slide stop in the horizontal mechanism 12 and a slide in the vertical adjustment mechanism 14. That is, the slide lock for the horizontal adjustment mechanism 12 and the slide for the vertical adjustment mechanism 14 are integrally formed.

Figure 2:
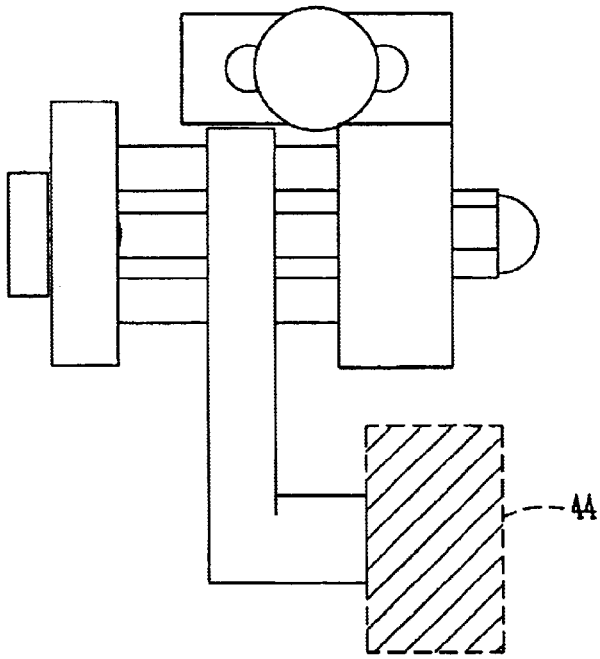
FIG. 2 is a top elevational view of the bow sight adjustment mechanism shown in FIG. 1 as attached to an archery bow shown in dashed lines.

FIG. 2 illustrates the preferred embodiment of the bow sight adjustment mechanism 10 as attached to a bow 44. It should be understood that the bow sight adjustment mechanism 10 can be easily adapted for attachment to any type of bow.

Figure 3:
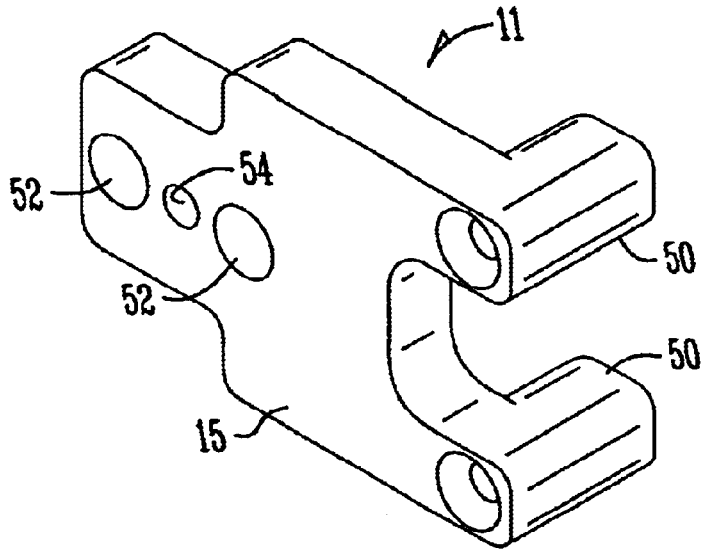
FIG. 3 is a perspective view of a sight mount.

The sight mount 11 is shown in more detail in FIG. 3. The sight mount 11 includes a slide portion 15 as discussed previously. The slide portion 15 includes a threadable aperture 54 for receiving the elongated screw 22 of the thumb screw 20. The slide portion 15 of the sight mount 11 also includes two apertures 52 that allow the dowel pins 26 to pass therethrough. The sight mount 11 further includes two legs 50 that are bored to enable screws to pass therethrough for attachment to the bow 44.

Figure 4:
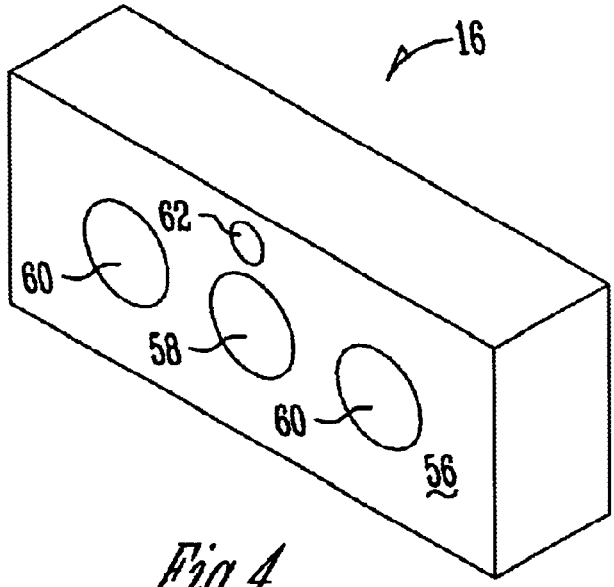
FIG. 4 is a perspective view of a slide lock.

One of the slide locks 16 is shown in FIG. 4. The slide lock 16 includes an aperture 58 to accommodate the screw 22 of the thumb screw 20. The slide lock also includes two additional apertures 60 in which the ends of the dowel pins 26 are secured by a pressed fit.

Figure 5:
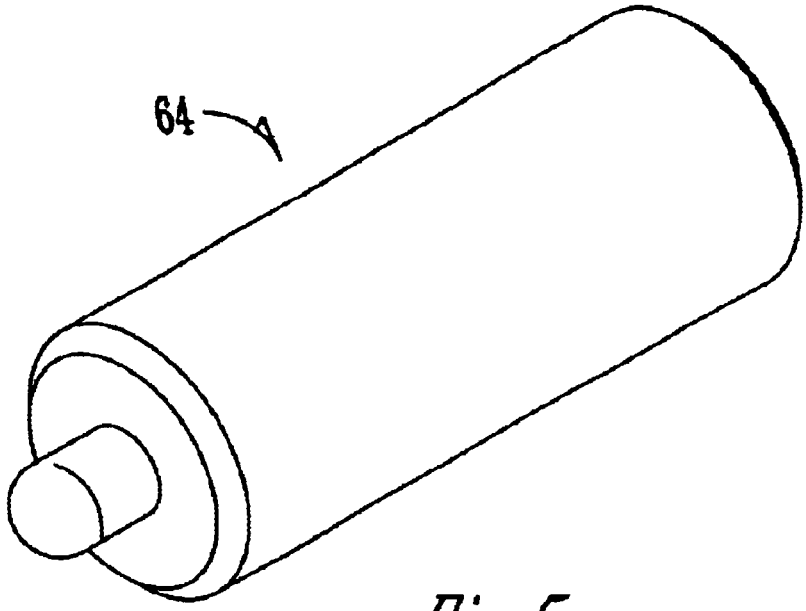
FIG. 5 is a perspective view of a plunger.
Figure 6:
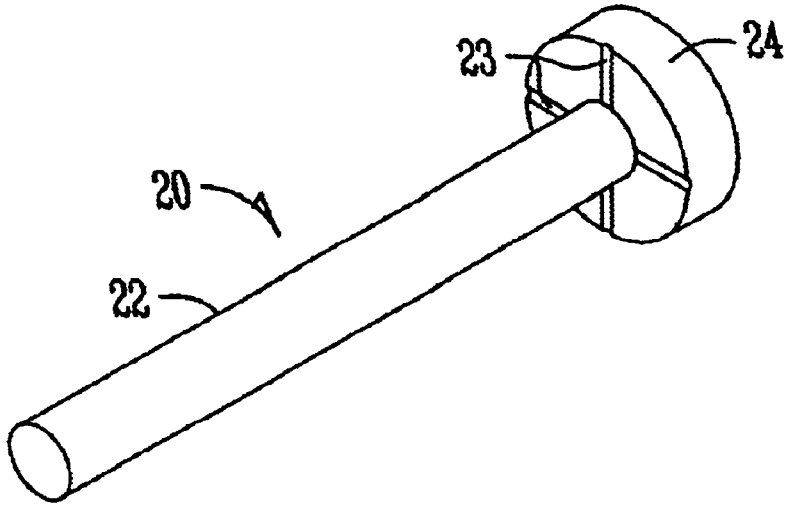
FIG. 6 is a perspective view of a thumb screw.

The slide lock 16 includes a surface 56 with a small aperture 62 bored into the surface adjacent the aperture 58. The small aperture 62 is provided for housing a spring-loaded plunger 64 or similar article (see FIG. 5). The spring-loaded plunger 64 is intended to fit into one of the detents 23 on the underside of the head 24 of the thumb screw 20 (see FIG. 6). This combination of elements allows for adjustments to be made in certain increments. In addition, this spring-loaded plunger 64 and thumb screw 20 in combination with the flexible bushings in the slide effectively limit unwanted or inadvertent movement of the bow sight adjustment mechanism 10, obviating the need for a separate locking mechanism.

Figure 7:
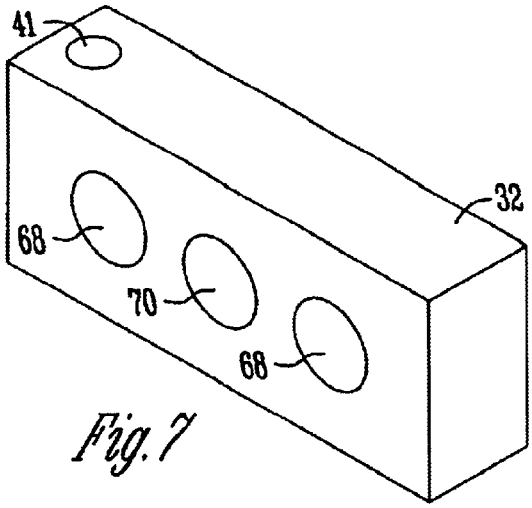
FIG. 7 is a perspective view of a slide stop.

One of the slide stops 32 is shown in FIG. 7. It generally includes an aperture 70 for receiving the elongated screw 36 of the thumb screw 34. Additional apertures 68 are also provided for securing the dowel pins 42 as discussed previously. An additional aperture 41 is provided for mounting a sighting element.

Figure 8:
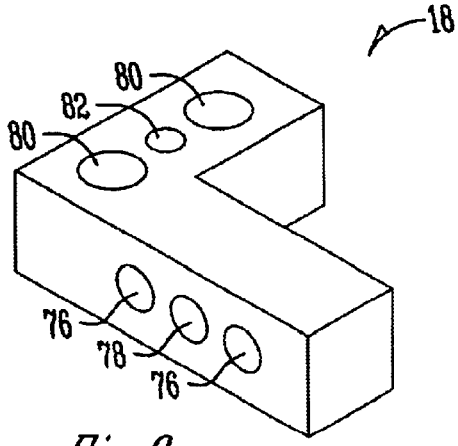
FIG. 8 is a perspective view of a L-shaped slide.

The L-shaped member 18 is shown in FIG. 8. As discussed previously, the L-shaped member acts as both a slide stop in the horizontal adjustment mechanism 12 and as a slide for the vertical adjustment mechanism 14. The L-shaped member 18 includes apertures 76 and 80 for receiving the dowel pins 26 and 42, respectively. Apertures 78 and 82 are also provided for receiving the screw device. Aperture 82 is of course threaded to enable the L-shaped member 18 to travel along the longitudinal axis of the screw 36.

Figure 9:
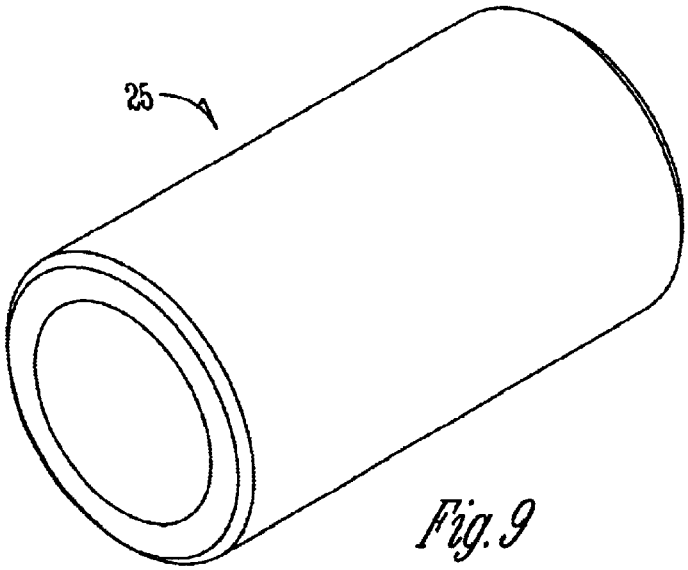
FIG. 9 is a perspective view of a flexible bushing.

FIG. 9 shows the flexible bushing 25 in greater detail. It has been found that nylon is the preferred material for the flexible bushing 25. A brass bushing has also been found suitable for various applications.

The bow sight adjustment mechanism 10 is easy to use. Once attached to the bow, the preferred method of sighting or adjusting the pins of the sighting element follows. First, it is important that the individual pins be spaced apart at an appropriate distance so that the archer can be assured that the pins cover a certain spread. For example, three pins may be sighted at five yard intervals therebetween. Once the individual pins are sighted then the sighting element, including all of the pins, can be adjusted using the horizontal and vertical adjustment mechanism (12 and 14). As explained previously, the combination of the spring-loaded plungers 64, head screws 24 and 38 with detents 23, dowel pins 26 and 42, and flexible bushings 25 helps to prevent unwanted or inadvertent movement of the adjustment mechanism due to "slop" or "play" between parts in the mechanism.

The primary parts of the bow sight adjustment mechanism are preferably made of steel. However, other high strength materials can also be used.

A general description of the present invention as well as a preferred embodiment of the present invention has been set forth above. Those skilled in the art to which the present invention pertains will recognize and be able to practice additional variations in the structure and method described which fall under the teachings of this invention. Accordingly, all such modifications and additions are deemed to be within the scope of the invention which is to be limited only by the claims appended hereto.

What is claimed is:

1. A new adjustable bow sight mechanism for use with a sighting element that obviates the need for a separate locking mechanism to maintain the sighting element in position, the adjustable bow sight mechanism comprising:

a sight mount adapted for attachment to a bow;

a first adjustment mechanism operatively connected to the sight mount and the sighting element for adjusting the sighting element in a first direction, the first adjustment mechanism including a slide lock, a slide stop, and a slide;

the slide lock, the slide stop and slide having apertures to allow the slide to move in between the slide lock and the slide stop in response to a rotation of a head; and the slide lock having a plunger extending to contact the head.

2. The adjustable bow sight mechanism of claim 1 further comprising at least one elongated spacing element having a first end fixed about the slide lock and a second end fixed about the slide stop.

3. The adjustable bow sight mechanism of claim 2 further comprising an aperture in the slide, the spacing element extending through the aperture, a flexible bushing disposed in the aperture between the slide and the spacing element.

4. The adjustable bow sight mechanism of claim 1 wherein the head moves the slide by a screw device.

5. The adjustable bow sight mechanism of claim 4 wherein the screw device moves the slide by interacting with a threaded aperture in the slide.

6. The adjustment bow sight mechanism of claim 1 wherein the head has at least one detent for the plunger to extend into.

7. The adjustment bow sight mechanism of claim 6 wherein the head has a plurality of detents.

8. The adjustable bow sight mechanism of claim 3 wherein the flexible bushings are nylon bushings.

9. The adjustable bow sight mechanism of claim 3 wherein the flexible bushings are brass bushings.

10. The adjustable bow sight mechanism of claim 1 further comprising a second adjustment mechanism operatively connected to the first adjustment mechanism and the sighting element for adjusting the sighting element in a second direction perpendicular the first direction.

11. The adjustable bow sight mechanism of claim 10 wherein the second adjustment mechanism comprises:

a slide lock, a slide stop, and a slide;

the slide lock, the slide stop and slide having apertures to allow the slide to move in between the slide lock and the slide stop in response to a rotation of a head; and the slide lock having a plunger extending to contact the head.

12. A new adjustable bow sight mechanism for use with a sighting element and a sight mount that obviates the need for a separate locking mechanism to maintain the sighting element in position, the adjustable bow sight mechanism comprising:

a first adjustment mechanism operatively connected to the sight mount and the sighting element for adjusting the sighting element in a first direction;

the first adjustment mechanism including a slide lock, a slide stop, and a slide mounted between the slide stop;

the slide lock on an elongated screw device extending between the slide stop and slide lock and through a threaded aperture in the slide;

the slide lock having an outer surface with a plunger extending therefrom that fits into a detent on a head of the screw device wherein the head can be rotated for adjusting the slide along the length of the screw device;

at least one elongated spacing element extending between the slide lock and the slide stop; and the slide having apertures for receiving the spacing elements with flexible bushings disposed between the slide and the spacing elements.

13. The adjustable bow sight mechanism of claim 12 wherein the flexible bushings are nylon bushings.

14. The adjustable bow sight mechanism of claim 12 wherein the flexible bushings are brass bushings.

15. The adjustable bow sight mechanism of claim 12 further comprising a second adjustment mechanism operatively connected to the first adjustment mechanism and the sighting element for adjusting the sighting element in a second direction perpendicular the first direction.

16. The adjustable bow sight mechanism of claim 15 wherein the second adjustment mechanism comprises:

a slide lock, a slide stop, and a slide mounted between the slide stop;

the slide lock on an elongated screw device extending between the slide stop and slide lock and through a threaded aperture in the slide;

the slide lock having an outer surface with a plunger extending therefrom that fits into a detent on a head of the screw device wherein the head can be rotated for adjusting the slide along the length of the screw device;

at least one elongated spacing element extending between the slide lock and the slide stop; and the slide having apertures for receiving the spacing elements with flexible bushings disposed between the slide and the spacing elements.

17. A first ever method of sighting a bow having a sighting element with a plurality of pins, the method comprising the steps of:

providing a bow;

providing an adjustable bow sight mechanism comprising a sight mount adapted for attachment to the bow, a first adjustment mechanism operatively connected to the sight mount and the sighting element for adjusting the sighting element in a first direction; the first adjustment mechanism including a slide lock, a slide stop, and a slide mounted between the slide stop; the slide lock on an elongated screw device extending between the slide stop and slide lock and through a threaded aperture in the slide; the slide lock having an outer surface with a plunger extending therefrom that fits into a detent on a head of the screw device wherein the head can be rotated for adjusting the slide along the length of the screw device; at least one elongated spacing element extending between the slide lock and the slide stop; and the slide having apertures for receiving the spacing elements with flexible bushings disposed between the slide and the spacing elements;

attaching the bow sight mount to the bow;

adjusting the plurality of pins in the sighting element individually to achieve a desired spacing of shots at different distances; and adjusting the sighting element by rotating the screw devices on the first adjustment mechanism.

18. The method of claim 17 wherein the adjustable bow sight mechanism has a second adjustment mechanism operatively connected to the first adjustment mechanism and the sighting element for adjusting the sighting element in a second direction perpendicular the first direction.

19. The method of claim 18 further comprising the step adjusting the sighting element by using the second adjustment mechanism.

20. The method of claim 18 wherein the second adjustment mechanism comprises a slide lock, a slide stop, and a slide mounted between the slide stop; the slide lock on an elongated screw device extending between the slide stop and slide lock and through a threaded aperture in the slide; the slide lock having an outer surface with a plunger extending therefrom that fits into a detent on a head of the screw device wherein the head can be rotated for adjusting the slide along the length of the screw device; at least one elongated spacing element extending between the slide lock and the slide stop; and the slide having apertures for receiving the spacing elements with flexible bushings disposed between the slide and the spacing elements.

* * * * *